US006815618B2

(12) United States Patent
Runge

(10) Patent No.: US 6,815,618 B2
(45) Date of Patent: Nov. 9, 2004

(54) METALLIC WIRE

(75) Inventor: Joachim Runge, Arolsen (DE)

(73) Assignee: Nexans, Paris (FR)

( * ) Notice: Subject to any disclaimer, the term of this patent is extended or adjusted under 35 U.S.C. 154(b) by 52 days.

(21) Appl. No.: 10/158,889

(22) Filed: Jun. 3, 2002

(65) Prior Publication Data

US 2002/0186115 A1 Dec. 12, 2002

(30) Foreign Application Priority Data

Jun. 6, 2001 (DE) ..... 101 27 556

(51) Int. Cl.[7] ..... H01B 5/08

(52) U.S. Cl. ..... 174/117 R; 174/117 F; 174/117 FF; 174/129 R

(58) Field of Search ..... 336/220–232; 174/42, 129 R, 117 R, 117 F, 117 FF

(56) References Cited

U.S. PATENT DOCUMENTS

| | | | | | |
|---|---|---|---|---|---|
| 1,132,673 | A | * | 3/1915 | Murray | 174/59 |
| 2,462,884 | A | * | 3/1949 | Miller, Jr. | 336/65 |
| 3,659,038 | A | * | 4/1972 | Shealy | 174/42 |
| 4,529,837 | A | * | 7/1985 | Borden | 174/125.1 |
| 5,171,942 | A | * | 12/1992 | Powers | 174/129 R |

FOREIGN PATENT DOCUMENTS

| | | | |
|---|---|---|---|
| JP | 04-024909 | * | 1/1992 |

* cited by examiner

*Primary Examiner*—Tuyen T. Nguyen
(74) *Attorney, Agent, or Firm*—Sughrue Mion, PLLC

(57) ABSTRACT

In a metallic wire for producing transformer windings, first segments (4*a*, 4*b*), in which the long axis of the cross section extends in a defined plane, alternate with second segments (4*c*), in which the long axis of the cross section extends perpendicular thereto.

1 Claim, 2 Drawing Sheets

METALLIC WIRE

This application is based on and claims priority from German Patent Application No. 10127556.0 filed Jun. 6, 2001, which is incorporated by reference herein.

BACKGROUND OF THE INVENTION

The invention relates to a metallic wire and to a winding for transformers.

In windings for oil-cooled transformers, paper-insulated wires or transposed conductors having a constant thickness/width ratio over their entire length are used. The wires are wound onto a magnetizable metal core.

Such an arrangement of the metal wires does not take into account the different field strengths in the center and at the ends.

As a consequence, the losses in the transformer are increased and the efficiency is reduced.

SUMMARY OF THE INVENTION

An object of the present invention is thus to provide a metal wire for transformer windings that obviates the described drawbacks, or to provide a winding that makes it possible to reduce the stray-field losses in a transformer and to improve the transformer's efficiency.

DETAILED DESCRIPTION OF THE INVENTION

Figure 1:
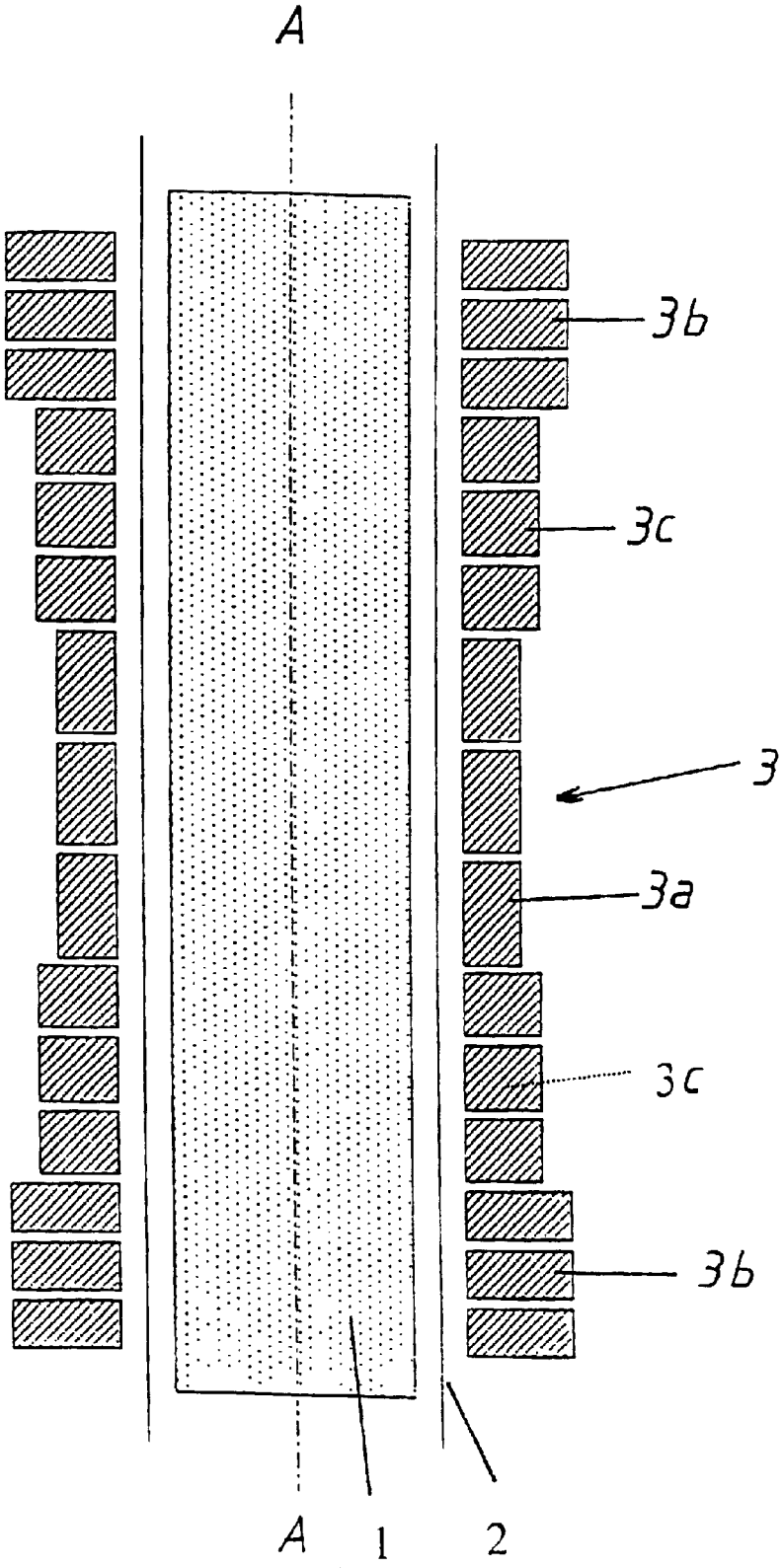
FIG. 1 depicts a winding.

FIG. 1 depicts a winding, e.g., for a transformer, which comprises an iron core 1 and a cylinder 2, e.g., made of paperboard or insulating board, which is arranged over the iron core. Iron core 1 and cylinder 2 are located in the interior of a wire winding 3. The wire winding 3 consists of a length of copper profile with a rectangular cross section. According to the teaching of the invention, this copper profile is wound such that in the center area 3*a* of winding 3 the long axis of the copper profile extends parallel to the center axis A of the winding. In contrast, in the end areas 3*b* of winding 3, the long axis of the copper profile extends perpendicular to the center axis A of winding 3. Between the areas 3*a* and 3*b*, i.e., at 3*c*, the copper profile 3 has a nearly square cross section.

By changing the cross section of the copper profile over the course of winding 3, the stray-field losses can be reduced and the efficiency of a transformer equipped with an inventive winding 3 can be increased.

The copper profile can be a solid flat copper wire. It is also possible, however, to use a profile comprising a plurality of conductor elements arranged one on top of the other, e.g., a so-called transposed conductor, which can be produced by Roebel transposition of flat conductor elements.

An exemplary embodiment of a production process will now be described in greater detail with reference to FIG. 2.

Figure 2:
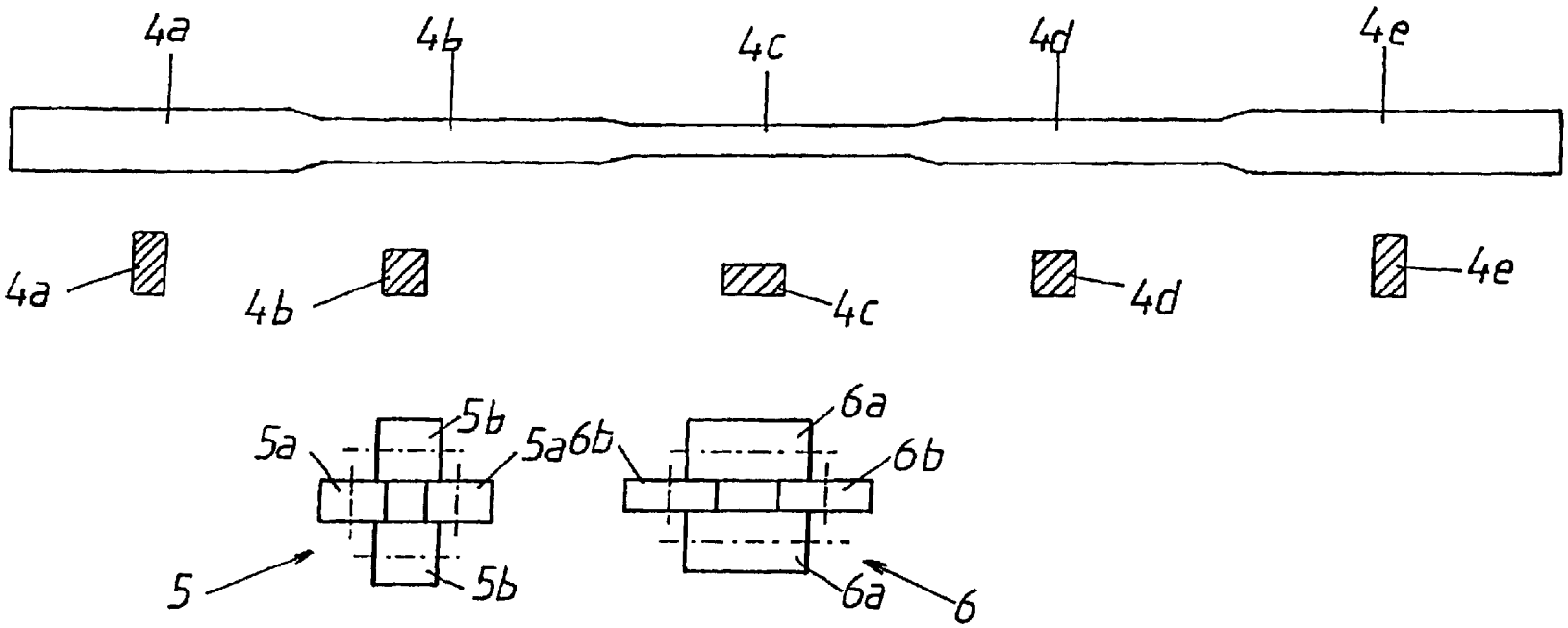
FIG. 2, illustrates a prooduction process according to the invention, with the upper half of FIG. 2 showing a side elevation of a metallic wire and the lower half of FIG. 2 showing the rolling machines.

The upper half of FIG. 2 shows a side elevation of a metallic wire 4 according to the teaching of the invention. This wire comprises a total of five segments 4*a*, 4*b*, 4*c*, 4*d* and 4*e*.

As shown in the section views, segments 4*a* and 4*e* have a flat profile with a long axis perpendicular to the horizontal, and segments 4*b* and 4*d* have a nearly square cross section. The center segment 4*c* is rotated by 90° relative to segments 4*a* and 4*e*.

Such a metallic wire 4 can be produced, for instance, by metallurgical joining techniques, e.g., by welding or soldering the individual segments 4*a* to 4*e*. The junctions between the segments 4*a* to 4*e* must be correspondingly adapted to each other, i.e., the cross section of the metal wire 4 must have the same size across the entire length.

Another method for producing the metal wire 4 is to shape the individual segments 4*b*, 4*c* and 4*d* by means of a sizing press or section rolling.

The lower half of FIG. 2 depicts the section rolling machines that are being used.

Section rolling machines 5 and 6 have two roll pairs each, 5*a* and 5*b* and 6*a* and 6*b*. The roll pairs 5*a* and 5*b* as well as 6*a* and 6*b* can advantageously be driven. They are furthermore adjustable in the direction of the roll nip.

The process sequence is as follows:

Segment 4*e* passes freely through the section rolling machines 5 and 6. When segment 4*d* reaches the first section rolling machine 5, the roll pairs 5*a* and 5*b* are adjusted such that a nearly square cross section results. Segment 4*d* with the square cross section passes freely through the section rolling machine 6.

Segment 4*e*, like segment 4*d*, is first shaped into a square cross section. When the shaped segment 4*c* reaches the second section rolling machine 6, the roll pairs 6*a* and 6*b* are adjusted as shown below and the square profile is shaped into a flat rectangular profile.

Segment 4*b* is shaped into a square by the rolling machine 5 and passes freely through rolling machine 6. Segment 4*a*, like segment 4*e*, is not being shaped and passes freely through the section rolling machines 5 and 6 in which the roll pairs 5*a* and 5*b* as well as 6*a* and 6*b* have been driven apart.

A metallic wire of great length can thus be produced. The wire segments required to produce the windings can then be cut from these wire lengths.

What is claimed is:

1. A metallic wire, preferably made of copper, with a flattened rectangular cross section for producing transformer windings, characterized in that first segments (4*a*, 4*e*), in which the long axis of the cross section extends in a first plane, alternate with second segments (4*c*), in which the long axis of the cross section extends in a second plane, which is perpendicular to the first plane, wherein third segments (4*b*, 4*d*) with a substantially square cross section are located between the first segments (4*a*, 4*e*) and the second segments (4*c*).

* * * * *